US008731206B1

(12) United States Patent
Park

(10) Patent No.: US 8,731,206 B1
(45) Date of Patent: May 20, 2014

(54) MEASURING SOUND QUALITY USING RELATIVE COMPARISON

(71) Applicant: Google Inc., Mountain View, CA (US)

(72) Inventor: Keun Young Park, Santa Clara, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/648,684

(22) Filed: Oct. 10, 2012

(51) Int. Cl.
*H04R 29/00* (2006.01)

(52) U.S. Cl.
USPC ..... 381/59

(58) Field of Classification Search
CPC ..... H04R 29/001
USPC ..... 381/58, 59, 60, 96, 92, 312, 77, 93; 700/94
See application file for complete search history.

(56) References Cited

U.S. PATENT DOCUMENTS

| | | | | |
|---|---|---|---|---|
| 7,496,205 | B2 * | 2/2009 | Kuhnel | 381/60 |
| 2008/0008070 | A1 * | 1/2008 | Kwon | 369/53.1 |
| 2009/0169032 | A1 * | 7/2009 | Choi | 381/94.1 |
| 2011/0064232 | A1 * | 3/2011 | Ruwisch | 381/59 |

* cited by examiner

*Primary Examiner* — Lun-See Lao
(74) *Attorney, Agent, or Firm* — Shumaker & Sieffert, P.A.

(57) ABSTRACT

Techniques for evaluating at least one relative audio quality parameter of a device, such as a mobile phone, are disclosed. The techniques can include testing in a standard, non-acoustically-isolated environment. The techniques can be used to evaluate whether the device is in compliance with a set of standards.

20 Claims, 3 Drawing Sheets

MEASURING SOUND QUALITY USING RELATIVE COMPARISON

TECHNICAL FIELD

The techniques provided herein relate to evaluating sound quality.

BACKGROUND

Devices, such as mobile phones, can include microphones to receive sound and generate a corresponding analog electrical signal. Such devices can also include analog-to-digital converters, which convert the analog electrical signal provided by the device's microphone to digital information.

Devices, such as mobile phones can include speakers to generate sound corresponding to an electrical signal. Such devices can also include digital-to-analog converters, which convert a digital signal to an analog electrical signal. Such an analog electrical signal can be provided to the device's speaker, through an amplifier, to produce sound.

SUMMARY

According to some implementations, a method is disclosed. The method includes outputting a sound from a reference speaker in the presence of a reference microphone and a test mobile device including a test mobile device microphone. The method also includes acquiring at least a portion of the sound by the reference microphone to produce a reference analog electrical signal, and converting the reference analog electrical signal to a reference digital signal corresponding to at least a portion of the sound. The method further includes acquiring, from the test mobile device, a test mobile device digital signal representing at least a portion of the sound, and computing a first sound quality parameter value for a portion of the reference digital signal corresponding to a time interval. The method further includes computing a second sound quality parameter value for a portion of the test mobile device digital signal corresponding to the time interval, determining a relative sound input quality parameter as a function of the first sound quality parameter value and the second sound parameter value, and displaying the relative sound input quality parameter.

The above implementations can optionally include one or more of the following. The first sound quality parameter and the second sound quality parameter can each include total harmonic distortion. The first sound quality parameter and the second sound quality parameter can each include a frequency response. The first sound quality parameter and the second sound quality parameter can each include a plurality of frequency responses. The method can include determining an alignment of a portion of the test mobile device digital signal and a portion of the reference digital signal. The method can include evaluating test mobile device compliance with at least one standard based on the relative sound input quality parameter. The at least one standard can include a set of standards that includes a specification for the reference microphone and the reference speaker.

According to some implementations, a method is disclosed. The method includes providing a first digital signal to a test mobile device including a test mobile device speaker to cause the test mobile device to output a first audible sound at least throughout a time interval. The method also includes outputting a second audible sound corresponding to a second digital signal from a reference speaker at least throughout the time interval, and receiving, by a reference microphone, the first audible sound and the second audible sound at least throughout the time interval. The method further includes computing, based on the receiving, a first sound quality parameter value for the first audible sound present during the time interval. The method further includes computing, based on the receiving, a second sound quality parameter value for the second audible sound present during the time interval, determining a relative sound output quality parameter as a function of the first sound quality parameter value and the second sound parameter value, and displaying the relative sound output quality parameter.

The above implementations can optionally include one or more of the following. The first audible sound can include a frequency different from a frequency of the second audible sound. The first sound quality parameter and the second sound quality parameter can each include total harmonic distortion. The first sound quality parameter and the second sound quality parameter can each include a frequency response. The first sound quality parameter and the second sound quality parameter can each include a plurality of frequency responses. The method can include evaluating test mobile device compliance with at least one standard based on the relative sound output quality parameter. The at least one standard can include a set of standards that includes a specification for the reference microphone and the reference speaker.

According to some implementations, a method is disclosed. The method includes providing a first digital signal to a test mobile device including a test mobile device speaker to cause the test mobile device to output a first audible sound. The method also includes outputting a second audible sound corresponding to a second digital signal from a reference speaker, receiving the first audible sound by a reference microphone, and receiving the second audible sound by the reference microphone. The method further includes computing, based on the receiving the first audible sound, a first sound quality parameter value for the first audible sound, and computing, based on the receiving the second audible sound, a second sound quality parameter value for the second audible sound. The method further includes determining a relative sound output quality parameter as a function of the first sound quality parameter value and the second sound parameter value, and displaying the relative sound output quality parameter.

The above implementations can optionally include one or more of the following. The first sound quality parameter and the second sound quality parameter can each include total harmonic distortion. The first sound quality parameter and the second sound quality parameter can each include a frequency response. The first sound quality parameter and the second sound quality parameter can each include a plurality of frequency responses. The method can include evaluating test mobile device compliance with at least one standard based on the relative sound output quality parameter. The at least one standard can include a set of standards that includes a specification for the reference microphone and the reference speaker.

Disclosed techniques provide certain technical advantages. Some implementations are capable of determining relative sound quality—which can be sufficient for device testing purposes—without requiring expensive equipment such as an anechoic chamber. Further, some implementations can operate in the presence of ambient noise. As such, some embodiments provide the ability to test sound quality in a less expensive and more noise tolerant way, thus achieving a technical advantage.

DESCRIPTION OF DRAWINGS

The accompanying drawings, which are incorporated in and constitute a part of this specification, illustrate implementations of the described technology. In the figures.

DETAILED DESCRIPTION

Testing absolute input and output sound quality of a device such as a mobile phone can include the use of expensive equipment, such as an anechoic chamber. Disclosed techniques include testing relative input and output sound quality of a device. The disclosed techniques do not require an anechoic chamber or an acoustically isolated environment.

Reference will now be made in detail to example implementations, which are illustrated in the accompanying drawings. Where possible the same reference numbers will be used throughout the drawings to refer to the same or like parts.

Figure 1:
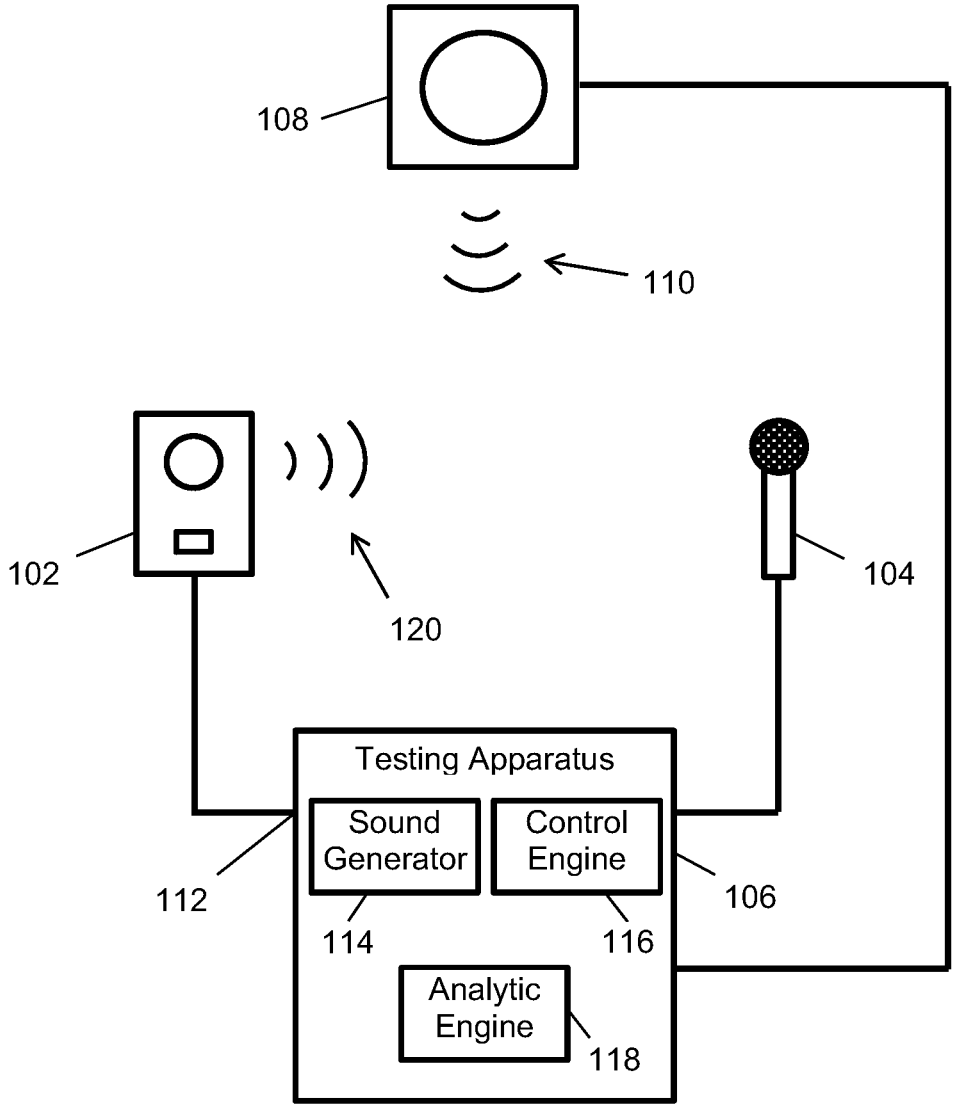
FIG. 1 is a schematic diagram of an example implementation.

FIG. 1 is a schematic diagram of an example implementation. The implementation of FIG. 1 includes testing apparatus 106. Testing apparatus 106 includes port 112 through which it can be communicatively coupled to a digital output of device under test 102. Testing apparatus 106 is capable of receiving digital information from device under test 102 using port 112, where the digital information represents sound received by a microphone of device under test 102. Testing apparatus 106 is further capable of sending digital information to device under test 102 using port 112, where the digital information represents sound to be output from a speaker of device under test 102.

Port 112 can comply with any of a variety of standards, e.g., USB, coaxial, etc., or have a different configuration altogether. In some implementations of testing apparatus 106, port 112 includes a wireless interface, e.g., complying with standards for 802.11 or Bluetooth. Some implementations of testing apparatus 108 include one or more physical (e.g., cable-connectable) ports and one or more wireless interfaces. Note that port 112 can allow two-way communication. Some implementations can instruct device under test 102 to set the internal gain of its microphone, or the volume of its speaker, for example.

Testing apparatus 106 also includes sound generator 114. Sound generator 114 is capable of generating signals representing sounds such as, e.g., individual sinusoidal tones of various frequencies at least throughout the range of human hearing (e.g., 20 Hz—20 kHz), other tones at least throughout the range of human hearing, white noise, pink noise, chirps, frequency sweeps, etc. Sound generator 114 is, in particular, capable of simultaneously generating multiple signals representing multiple sounds, e.g., two or more sinusoidal tones of different frequencies, two or more segments of white noise covering different parts of the audio spectrum, etc. Sound generator 114 can produce both analog and digital signals representing sounds. To that end, sound generator 114 can include one or both of an analog-to-digital converter and a digital-to-analog converter. Sound generator 114 is coupled to control engine 116.

Testing apparatus 106 further includes, or is operably coupled to, reference speaker 108, which can produce audio output 110 reflecting a signal provided by sound generator 114 of testing apparatus 106. More particularly, reference speaker 108 is coupled to sound generator 114 through an amplifier. Audio output 110 of reference speaker 108 is controlled by control engine 116, which controls the output of sound generator 114.

Testing apparatus 106 further includes, or is operably coupled to, reference microphone 104. Reference microphone 104 or testing apparatus 106 can include an analogue-to-digital converter, which converts analog electrical signals provided by reference microphone 104 to digital information. Both reference speaker 108 and reference microphone 104 can be high-quality commodity instruments, obtainable on the open market.

Testing apparatus 116 includes analytic engine 118. Analytic engine 118 is configured to calculate sound quality parameters. Analytic engine 118 can calculate sound quality parameters for captured audio represented in either analog or digital formats. An example sound quality parameter is total harmonic distortion. Total harmonic distortion can be calculated as, for example, a ratio of a fundamental frequency power to the summed powers of the harmonic frequencies, for any fundamental frequency at least within the range of human hearing. Frequency response can be calculated as, for example, a plurality of decibel measurements at each of a plurality of frequencies at least within the range of human hearing. To assist with calculating sound quality parameters, analytic engine can include various filters (e.g., FIR filters, notch filters, etc.) and other components such as Fourier transform and inverse Fourier transform modules. All or part of analytic engine 118 can be implemented using hardware, firmware, processor-implemented software, or a combination thereof.

Testing apparatus 106 further includes control engine 116. Control engine 116 is configured to automatically execute a testing routine to determine at least one relative sound quality parameter of device under test 102. In particular, testing apparatus 106 can evaluate both relative sound input quality of device under test 102 and relative sound output quality of device under test 102.

To prepare for a test routine, a user positions one or more of reference speaker 108, device under test 102 and reference microphone 104 such that both device under test 102 and reference microphone 104 receive audio output from reference speaker 108, and such that reference microphone 104 receives audio output from both device under test 102 and reference speaker 108. For example, device under test 102, reference speaker 108, and reference microphone 104 can be equidistant from each-other. These components can be positioned in a normal room and device under test 102 tested without requiring, for example, an anechoic chamber.

In general, a relative sound input quality test routine executed by control engine 116 can operate as follows. A user activates testing apparatus 106 to perform a measurement of at least one relative sound input quality parameter. Control engine 116 activates sound generator 114 to generate a signal for one or more sounds appropriate for the sound input parameter being measured. Control engine 116 further directs sound generator 114 to provide the signal to an amplifier, which provides an electrical signal to reference speaker 108, which in turn outputs the corresponding audio sound or sounds.

Device under test 102 and reference microphone 104 each capture the audio provided by reference speaker 108. Device under test 102 and reference microphone 104 provide respective electrical signals representing the received audio to testing apparatus 106. Such signals can be analog or digital. Testing apparatus 106 conveys the signals to analytic engine 118, which calculates respective sound input quality parameters for device under test 102 and reference microphone 104.

Analytic engine 118 then calculates a relative sound input quality parameter from the individual respective sound input quality parameters, and testing apparatus 106 displays the relative sound input quality parameter in human readable form, e.g., visually using a display screen.

The relative sound input quality parameter may be expressed as a function of the absolute sound input quality parameter of reference microphone 104. For example, the relative sound input quality parameter for total harmonic distortion at a particular frequency can be expressed as a maximal percentage difference from a (possibly unknown) total harmonic distortion at that frequency of reference microphone 104. As another example, the relative sound input quality parameter for frequency response can be expressed as, for each of a plurality of test frequencies within a test frequency range, a maximal decibel difference from a (possibly unknown) frequency response of reference microphone 104. As another example, the relative sound input quality parameter for frequency response can be expressed as a maximum difference between any two maximal decibel differences each associated with one of the plurality of test frequencies. That is, the relative sound input quality parameter for frequency response can be expressed as the greatest difference (e.g., in decibels) between any two relative frequency response measurements in a given frequency range.

In general, a relative sound output quality test routine executed by control engine 116 can operate as follows. A user activates testing apparatus 106 to perform a measurement of at least one relative sound output quality parameter. Control engine 116 activates sound generator 114 to generate a signal for one or more sounds appropriate for the sound output parameter being measured. Control engine 116 further directs sound generator 114 to provide the signal to an amplifier, which provides an electrical signal to reference speaker 108, which in turn outputs the corresponding audio sound or sounds. Further, control engine 116 provides a digital version of the signal of sound generator 114 to device under test 102. Device under test 102 produces the corresponding sound using its speaker. Control engine 116 can provide signals to reference speaker 108 and device under test 102 simultaneously or serially.

Reference microphone 104 captures the audio provided by reference speaker 108 and device under test 102. Reference microphone 104 provides respective electrical signals representing the received audio to testing apparatus 106. Such signals can be analog or digital. Testing apparatus 106 conveys the signals to analytic engine 118, which calculates respective sound output quality parameters for device under test 102 and reference speaker 108.

Analytic engine 118 then calculates a relative sound output quality parameter from the individual respective sound output quality parameters, and testing apparatus 106 displays the relative sound output quality parameter in human readable form, e.g., visually using a display screen.

The relative sound output quality parameter may be expressed as a function of the absolute sound output quality parameter of reference speaker 108. For example, the relative sound output quality parameter for total harmonic distortion at a particular frequency can be expressed as a maximal percentage difference from a (possibly unknown) total harmonic distortion at that frequency of reference speaker 108. As another example, the relative sound output quality parameter for frequency response can be expressed as, for each of a plurality of test frequencies within a test frequency range, a maximal decibel difference from a (possibly unknown) frequency response of reference speaker 108. As another example, the relative sound output quality parameter for frequency response can be expressed as a maximum difference between any two maximal decibel differences each associated with one of the plurality of test frequencies. That is, the relative sound output quality parameter for frequency response can be expressed as the greatest difference (e.g., in decibels) between any two relative frequency response measurements in a given frequency range.

Once testing apparatus has produced at least one relative sound input quality parameter and/or at least one relative sound output quality parameter, a user can make decisions about the sound quality of device under test 102. Such decisions include whether to certify the device under test as being compliant with a particular set of standards, e.g., a proprietary set of audio quality standards.

In general, testing apparatus 106 can be at least partially implemented using a general purpose computer with appropriate software. Alternately, or in addition, testing apparatus 106 can be implemented using dedicated hardware, firmware, software, or any combination thereof. For example, all or part of control engine 116, sound generator 114 and analytic engine 118 can be implemented using hardware, firmware, processor-implemented software, or a combination thereof.

Figure 2:
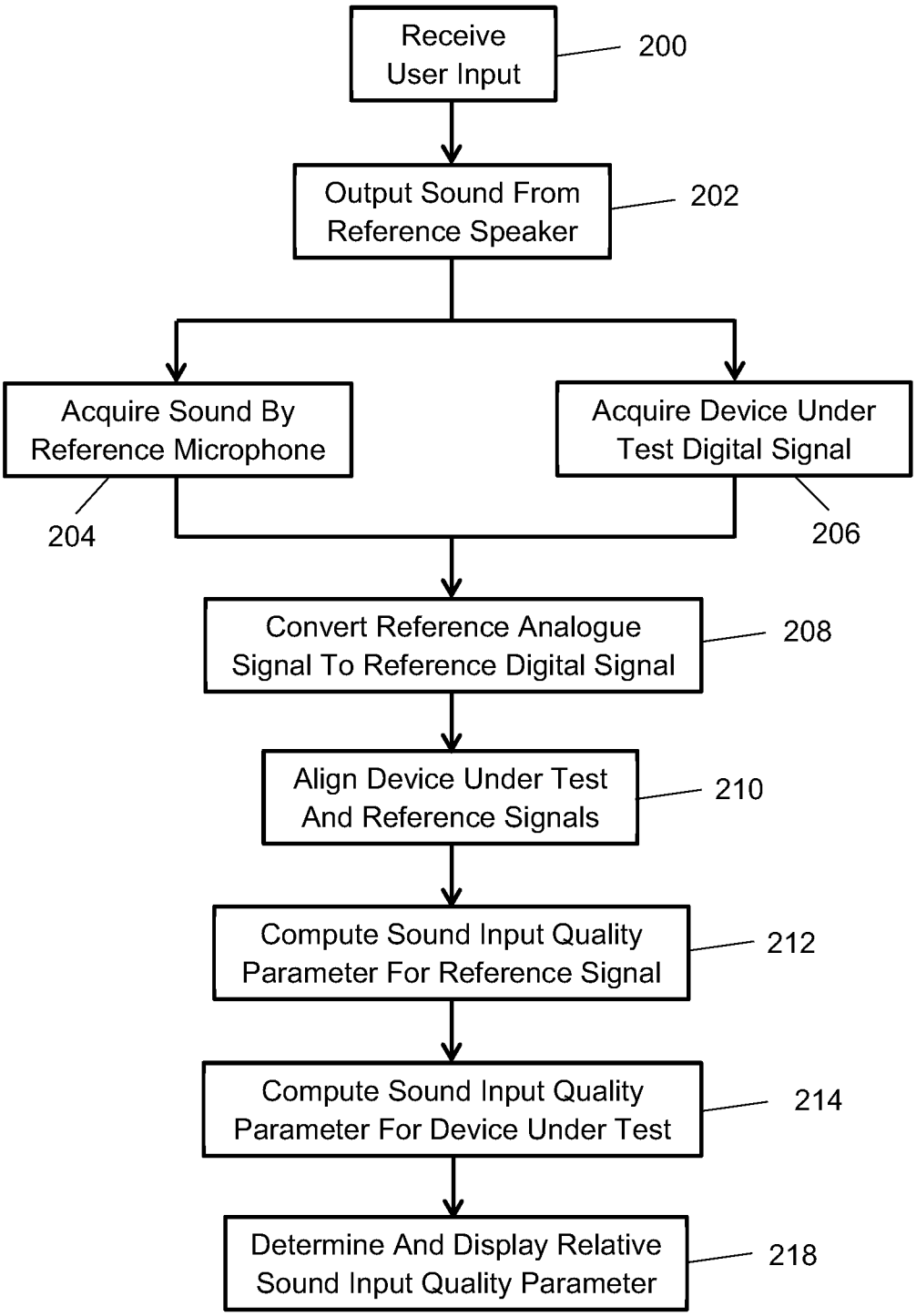
FIG. 2 is a flowchart of a method for testing relative sound input quality according to some implementations.

FIG. 2 is a flowchart of a method for testing relative sound input quality according to some implementations. The method of FIG. 2 can be implemented using a testing apparatus as described above in reference to FIG. 1. A user can prepare for the method of FIG. 2 by positioning a reference speaker, a reference microphone, and a device under test as described above in reference to FIG. 1. That is, the device under test and the reference microphone can each be the same distance from the reference speaker. These instruments can be set up in a normal room.

At block 200, the testing apparatus receives user input. The testing apparatus can receive user input through a variety of interfaces, such as standard keyboards, touchscreens, computer mice, and combinations of the preceding. The user input can include specifications of various criteria. For example, at block 200, the user can specify what sound input quality parameter or parameters to measure. Also, the user can specify the frequency or frequencies at which to measure the sound input quality parameter or parameters. The user can select multiple sound input quality parameters and multiple frequencies. For purposes of illustration, the user can select measuring both frequency response and total harmonic distortion at each of 100 Hz, 200 Hz, 400 Hz, 800 Hz, 1.6 kHz, 3.2 kHz, 6.4 kHz, and 8 kHz. Also at this block, the testing apparatus can instruct the device under test to set the internal gain of its microphone, e.g., to maximum.

At block 202, the testing apparatus automatically causes the reference speaker to output sounds necessary to test the selected sound input quality parameters. Continuing the example, the testing apparatus can output segments (e.g., 1 second segments) of pure sinusoidal tones at each of 100 Hz, 200 Hz, 400 Hz, 800 Hz, 1.6 kHz, 3.2 kHz, 6.4 kHz, and 8 kHz.

At block 204, the reference microphone acquires the sounds output by the reference speaker. At substantially the same time, at block 206, the testing apparatus acquires from the device under test digital information representing the sound output from the reference speaker. The testing apparatus can receive data representing the sounds from the device under test through a digital interface, e.g., using port 112 of FIG. 1. There may be a slight time difference between blocks 206 and 208 caused by, e.g., the device under test converting captured analog sound to the digital domain. The testing apparatus can store the digital information in volatile or persistent memory, e.g., a hard drive or flash memory.

At block 208, the testing apparatus converts the sound captured by the reference microphone to digital format, e.g., using an analog-to-digital converter. The testing apparatus can store the digital information in volatile or persistent memory, e.g., a hard drive or flash memory.

At block 210, the testing apparatus aligns the signals represented by the digital information obtained at blocks 206 and 208 in the temporal domain. That is, the testing apparatus compares the digital information from the device under test and from the reference microphone and determines at least one point in time at which the represented sounds align. The testing apparatus can utilize correlation, for example, to align the signals.

At block 212, the testing apparatus computes at least one sound input quality parameter for the reference signal. If the testing routine includes multiple sounds and/or multiple sound quality parameters, then this block can be repeated multiple times for each sound and/or sound quality parameter. Continuing the example, the testing apparatus can compute the total harmonic distortion present at each of the selected frequencies (100 Hz, 200 Hz, 400 Hz, 800 Hz, 1.6 kHz, 3.2 kHz, 6.4 kHz, and 8 kHz), as well as the frequency response at each of these frequencies. At this block, the testing apparatus also notes what part or parts of the signal it uses for its calculation or calculations. The testing apparatus can make use of the alignment of block 210 in order to note the part or parts of the signal used.

At block 214, the testing apparatus computes at least one sound input quality parameter for the device under test signal. In particular, the testing apparatus computes the sound input quality parameter or parameters for the same part or parts of the signal for which it computed the parameter or parameters of block 212. The testing apparatus uses the signal alignment determined at block 210 in order to ensure that it computes the sound input quality parameter or parameters for the same time period or periods for which it performed the computation or computations of block 212.

At block 218, the testing apparatus computes at least one relative sound input quality parameter based on the computations of blocks 212 and 214.

For total harmonic distortion, the computation can be of a difference between a total harmonic distortion at a particular frequency and time computed at block 212 for the reference microphone signal, and a total harmonic distortion at the same frequency and time computed at block 214 for the device under test. The testing apparatus can perform this computation for a variety of frequencies.

For frequency response, the testing apparatus can compute, for each of a plurality of frequencies, a difference between a decibel determination for the reference microphone and a decibel determination for the device under test. The testing apparatus can further compute a greatest difference between any two of the aforementioned differences.

Also at block 218, the testing apparatus displays the relative sound input parameter or parameters that it computes. The display can be through a computer monitor or other display device, for example.

Figure 3:
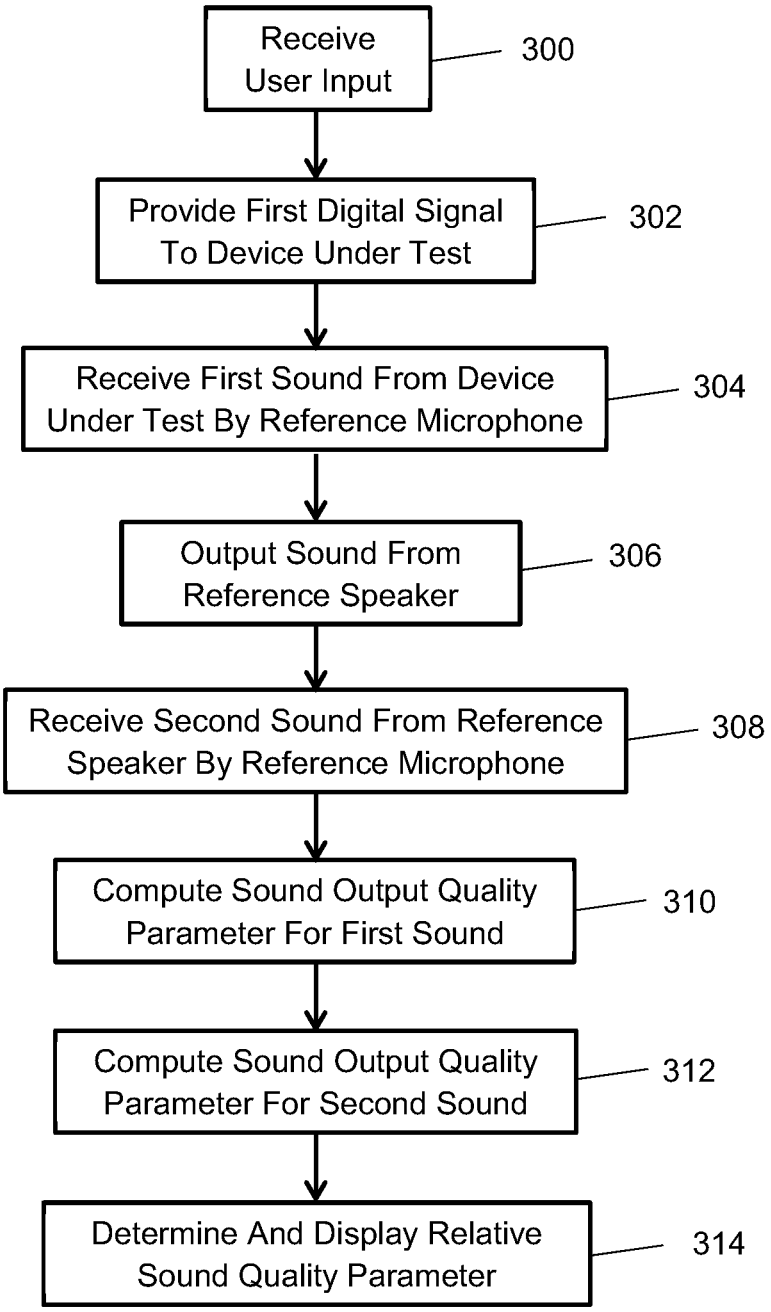
FIG. 3 is a flowchart of a method for testing relative sound output quality according to some implementations.

FIG. 3 is a flowchart of a method for testing relative sound output quality according to some implementations. The method of FIG. 3 can be implemented using a testing apparatus as described above in reference to FIG. 1. A user can prepare for the method of FIG. 3 by positioning a reference speaker, a reference microphone, and a device under test as described above in reference to FIG. 1. That is, the device under test and the reference speaker can each be the same distance from the reference microphone. These instruments can be set up in a normal room.

At block 300, the testing apparatus receives user input. The testing apparatus can receive user input through a variety of interfaces, such as standard keyboards, touchscreens, computer mice, and combinations of the preceding. The user input can include specifications of various criteria. For example, at block 300, the user can specify what sound output quality parameter or parameters to measure. Also, the user can specify the frequency or frequencies at which to measure the sound output quality parameter or parameters. The user can select multiple sound output quality parameters and multiple frequencies. For purposes of illustration, the user can select measuring both frequency response and total harmonic distortion at each of 100 Hz, 200 Hz, 400 Hz, 800 Hz, 1.6 kHz, 3.2 kHz, 6.4 kHz, and 8 kHz. Also at this block, the testing apparatus can instruct the device under test to set the volume of its speaker, e.g., to any percent of its maximum volume between 1% and 100%.

At block 302 the testing apparatus provides a first digital signal to the device under test. The first digital signal represents a sound necessary to test the selected sound output quality parameters. Continuing the example, the testing apparatus can direct to the device under test digital signals representing sound segments (e.g., 1 second segments) of pure sinusoidal tones at each of 100 Hz, 200 Hz, 400 Hz, 800 Hz, 1.6 kHz, 3.2 kHz, 6.4 kHz, and 8 kHz.

At block 304, the reference microphone receives a first sound from the device under test. The reference microphone generates a corresponding electrical signal, which is provides to the testing apparatus.

At block 306, the reference speaker outputs a sound corresponding to a signal produced by the testing apparatus. The sound output of block 306 can occur at the same time, or at a different time, as compared to the time of the sound output by the device under test. For example, for testing relative sound output quality at sound levels above that of the ambient noise in the testing environment, the sound outputs of the device under test and the reference speaker can be at different times. The signals provided to the device under test and to the reference speaker can represent the same sound in this example. Because both sounds are at volumes above that of the ambient noise, their quality can be compared in a non-anechoic or non-acoustically-isolated environment without noise appreciably affecting the test.

As another example, for testing relative sound quality outputs at sound levels at or below that of the ambient noise of the testing environment, the sound outputs of the device under test and the reference speaker can occur at the same time. The signals provided to the device under test and to the reference speaker can represent different sounds under these circumstances. Thus, for testing both frequency response and total harmonic distortion at each of 100 Hz, 200 Hz, 400 Hz, 800 Hz, 1.6 kHz, 3.2 kHz, 6.4 kHz, and 8 kHz, signals representing sounds at different frequencies can be provided simultaneously to the device under test and to the reference speaker pairwise, until each of the device under test and the reference speaker have produced sounds at each of the test frequencies. Because the sounds are at volumes at or below that of the ambient noise, yet both sounds occur simultaneously, any sound output quality degradation caused by ambient noise will cancel out and not appreciably affect the test.

At block 308, the reference microphone acquires the sound output by the reference speaker. The reference microphone generates a corresponding electrical signal, which is provides to the testing apparatus.

At block 310, the testing apparatus computes a sound quality parameter for the sound output from the device under test. The testing apparatus utilizes, e.g., analytic engine 118 to perform the computations, and bases the computations on the input received from the user at block 300. If sounds are output from the device under test and the reference speaker simultaneously, then the testing apparatus separates the sounds prior to testing according to this block. The testing apparatus can use, e.g., analytic engine to perform the separation. Separation can utilize, for example, conversion to the frequency domain using a Fourier transform, notch filtering, band-pass filtering, high-pass filtering, low-pass filtering, etc.

If the testing routine includes multiple sounds and/or multiple sound quality parameters, then block 308 can be repeated multiple times for each sound and/or sound quality parameter. Continuing the example, the testing apparatus can compute the total harmonic distortion present at each of the selected frequencies (100 Hz, 200 Hz, 400 Hz, 800 Hz, 1.6 kHz, 3.2 kHz, 6.4 kHz, and 8 kHz), as well as the frequency response at each of these frequencies.

At block 312, the testing apparatus computes a sound quality parameter for the sound output from the reference speaker. The computation of block 312 proceeds similarly to that of block 310, but operates on the signal corresponding to the sound output from the reference speaker rather than that of the device under test. Again, prior to this block, the testing apparatus separates sounds if the device under test and the reference speaker produced their respective sounds simultaneously.

At block 314, the testing apparatus computes at least one relative sound input quality parameter based on the computations of blocks 310 and 312.

For total harmonic distortion, the computation can be of a difference between a total harmonic distortion at a particular frequency computed at block 312 for the reference speaker signal, and a total harmonic distortion at the same frequency computed at block 310 for the device under test. The testing apparatus can perform this computation for a variety of frequencies.

For frequency response, the testing apparatus can compute, for each of a plurality of frequencies, a difference between a decibel determination for the reference speaker and a decibel determination for the device under test. The testing apparatus can further compute a greatest difference between any two of the aforementioned differences.

Also at block 218, the testing apparatus displays the relative sound input parameter or parameters that it computes. The display can be through a computer monitor or other display device, for example.

Once the testing apparatus displays the relative sound input and output parameter or parameters, the user or another party can make a determination about the device under test. For example, the determination can be with respect to a proprietary or public set of standards. The set of standards can specify the particular make and model of reference microphone, reference speaker and analog-to-digital converter used by the testing apparatus. The set of standards can further specify minimal acceptable values for one or more sound quality parameters. If the device under test meets or exceeds the specified minimal sound quality parameter values, then the device under test can be declared to be in compliance at least with the particular part of the set of standards regarding relative sound quality parameters. Otherwise, the device under test can be declared not in compliance. The user or other party can then take action based on whether the device under test is in compliance or not. For example, one type of action is to authorize, or recommend authorization, for production of the device under test in increased quantities, assuming that the device under test is compliant. For a non-compliant device under test, one type of action is to stop, or recommend stopping, production of the device under test. Additionally, or in the alternative, the device under test can be re-engineered in order to improve sound quality and be subsequently re-tested.

In general, systems capable of performing the disclosed techniques can take many different forms. Further, the functionality of one portion of the system can be substituted into another portion of the system. Each hardware component can include one or more processors coupled to random access memory operating under control of, or in conjunction with, an operating system. The testing apparatus can include network interfaces to connect with clients or servers through a network. Further, each hardware component can include persistent storage, such as a hard drive or drive array, which can store program instructions to perform the techniques disclosed herein. That is, such program instructions can serve to perform techniques as disclosed. Other configurations of testing apparatus 106 and other hardware, software, and service resources are possible.

The foregoing description is illustrative, and variations in configuration and implementation can occur. Other resources described as singular or integrated can in implementations be plural or distributed, and resources described as multiple or distributed can in implementations be combined. The scope of the disclosure is accordingly intended to be limited only by the following claims.

What is claimed is:

1. A method comprising:

outputting a sound from a reference speaker in the presence of a reference microphone and a test mobile device comprising a test mobile device microphone and a test mobile device speaker;

acquiring at least a portion of the sound by the reference microphone to produce a reference analog electrical signal;

converting the reference analog electrical signal to a reference digital signal corresponding to at least a portion of the sound;

acquiring, from the test mobile device, a test mobile device digital signal representing at least a portion of the sound;

computing a first sound quality parameter value for a portion of the reference digital signal corresponding to a time interval;

computing a second sound quality parameter value for a portion of the test mobile device digital signal corresponding to the time interval;

determining a relative sound input quality parameter as a function of the first sound quality parameter value and the second sound parameter value; and displaying the relative sound input quality parameter.

2. The method of claim 1, wherein the first sound quality parameter and the second sound quality parameter each comprise total harmonic distortion.

3. The method of claim 1, wherein the first sound quality parameter and the second sound quality parameter each comprise a frequency response.

4. The method of claim 1, wherein the first sound quality parameter and the second sound quality parameter each comprise a plurality of frequency responses.

5. The method of claim 1, further comprising determining an alignment of a portion of the test mobile device digital signal and a portion of the reference digital signal.

6. The method of claim 1, further comprising evaluating test mobile device compliance with at least one standard based on the relative sound input quality parameter.

7. The method of claim 6, wherein the at least one standard comprises a set of standards that comprise a specification for the reference microphone and the reference speaker.

8. A method comprising:

providing a first digital signal to a test mobile device comprising a test mobile device speaker and a test mobile device microphone to cause the test mobile device to output a first audible sound at least throughout a time interval;

outputting a second audible sound corresponding to a second digital signal from a reference speaker at least throughout the time interval;

receiving, by a reference microphone, the first audible sound and the second audible sound at least throughout the time interval;

computing, based on the receiving, a first sound quality parameter value for the first audible sound present during the time interval;

computing, based on the receiving, a second sound quality parameter value for the second audible sound present during the time interval;

determining a relative sound output quality parameter as a function of the first sound quality parameter value and the second sound parameter value; and displaying the relative sound output quality parameter.

9. The method of claim 8, wherein the first audible sound comprises a frequency different from a frequency of the second audible sound.

10. The method of claim 8, wherein the wherein the first sound quality parameter and the second sound quality parameter each comprise total harmonic distortion.

11. The method of claim 8, wherein the first sound quality parameter and the second sound quality parameter each comprise a frequency response.

12. The method of claim 8, wherein the first sound quality parameter and the second sound quality parameter each comprise a plurality of frequency responses.

13. The method of claim 8, further comprising evaluating test mobile device compliance with at least one standard based on the relative sound output quality parameter.

14. The method of claim 13, wherein the at least one standard comprises a set of standards that comprise a specification for the reference microphone and the reference speaker.

15. The method comprising:

providing a first digital signal to a test mobile device comprising a test mobile device speaker and a test mobile device microphone to cause the test mobile device to output a first audible sound;

outputting a second audible sound corresponding to a second digital signal from a reference speaker;

receiving the first audible sound by a reference microphone;

receiving the second audible sound by the reference microphone;

computing, based on the receiving the first audible sound, a first sound quality parameter value for the first audible sound;

computing, based on the receiving the second audible sound, a second sound quality parameter value for the second audible sound;

determining a relative sound output quality parameter as a function of the first sound quality parameter value and the second sound parameter value; and displaying the relative sound output quality parameter.

16. The method of claim 15, wherein the first sound quality parameter and the second sound quality parameter each comprise total harmonic distortion.

17. The method of claim 15, wherein the first sound quality parameter and the second sound quality parameter each comprise a frequency response.

18. The method of claim 15, wherein the first sound quality parameter and the second sound quality parameter each comprise a plurality of frequency responses.

19. The method of claim 15, further comprising evaluating test mobile device compliance with at least one standard based on the relative sound output quality parameter.

20. The method of claim 19, wherein the at least one standard comprises a set of standards that comprise a specification for the reference microphone and the reference speaker.

* * * * *